United States Patent [19]

Miknaitis

[11] 4,063,205

[45] Dec. 13, 1977

[54] PRINTED WIRING CARD MOUNTABLE REED RELAY

[75] Inventor: Sigitas Miknaitis, Clarendon Hills, Ill.

[73] Assignee: GTE Automatic Electric Laboratories Incorporated, Northlake, Ill.

[21] Appl. No.: 689,880

[22] Filed: May 25, 1976

[51] Int. Cl.[2] ..... H01H 9/02; H01H 51/28

[52] U.S. Cl. ..... 335/202; 335/152

[58] Field of Search ..... 335/202, 151, 152, 153, 335/154

[56] References Cited

U.S. PATENT DOCUMENTS 3,940,722 2/1976 Fox et al. ..... 335/202

*Primary Examiner*—Harold Broome

[57] ABSTRACT

An improved magnetic latching reed relay construction includes a hollow bobbin having an integrally formed flange and a base portion on each end. The bobbin is formed in one piece from a thermoplastic material. At least one reed switch is disposed within the bobbin. Mechanical support and electrical connections to the reed switch are provided by terminals disposed through each base portion so that they extend above the base portions. A plurality of terminals disposed through each base portion extend downwards therefrom to provide electrical connections to control coils wound about the bobbin.

9 Claims, 5 Drawing Figures

PRINTED WIRING CARD MOUNTABLE REED RELAY

BACKGROUND OF THE INVENTION

1. Field of the Invention

This invention relates generally to the field of electromagnetic switches and more particularly to a new and improved magnetic latching reed relay construction.

2. Description of the Prior Art

Reed relays commonly include one or more reed switches each having a pair of encapsulated reeds having overlapping free ends that operate as normally open electrical contacts. In one type of reed relay, the reeds are constructed from a remanently magnetic material which when exposed to a magnetic flux will assume a magnetic state and remain in that state until exposed to a magnetic flux of opposite direction. The reed switches are typically placed within a hollow bobbin upon which control coils are wound. Current pulses are selectively applied to the coils to produce magnetic flux fields. For an illustration of one such magnetic latching relay, reference may be had to U.S. Pat. No. 3,793,601 which issued to R. J. Angner et al on Feb. 19, 1974.

One problem with reed relays is providing a relay construction which has the features of economical production and assembly and which is designed so that the relay may be mounted to printed circuit cards.

SUMMARY OF THE INVENTION

In accordance with the principles of this invention, a reed relay includes a hollow bobbin having a flange and a base portion on each end. At least one reed switch is disposed longitudinally within the bobbin. Terminals extending through each base portion are connected to the reed switch leads and provide mechanical support and electrical connections. A plurality of control coils are wound about the bobbin. In the illustrative embodiment three control coils are employed and the control coil leads are connected to terminals which extend from the bottoms of the base portions of the bobbin.

An illustrative embodiment in accordance with the principles of this invention includes a spacer having a pair of circumferential flanges formed at the substantial midpoint of the bobbin which serve to retain the control coils. The spacer supports a terminal for commoning ends of the control coils.

BRIEF DESCRIPTION OF THE DRAWINGS

The invention may best be understood by reference to the following description taken in conjunction with the accompanying drawings, in which like reference numerals identify like elements in the several figures and in which.

DESCRIPTION OF THE PREFERRED EMBODIMENT

Figure 1:
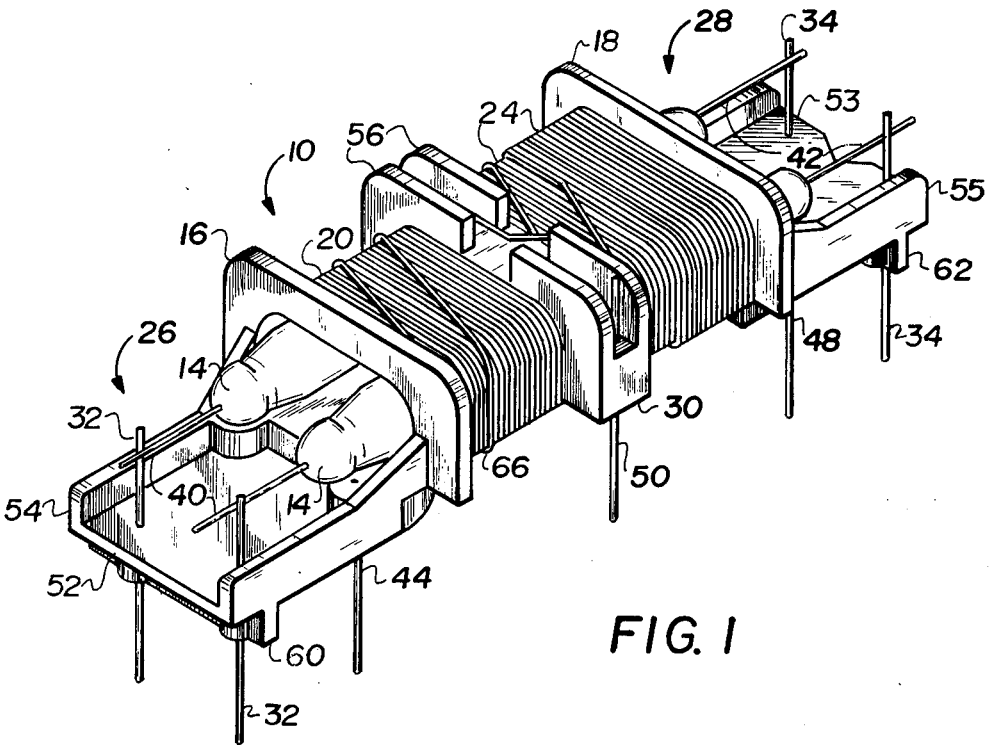
FIG. 1 is a perspective view of a reed relay assembly in accordance with the principles of this invention.

The main component from a manufacturing point of view of the reed relay illustrated in FIG. 1 is the bobbin shown generally at 10 which is typically molded in one piece from a suitable insulative thermoplastic material. The bobbin 10 has a longitudinal channel 12 adapted to receive the reed switch capsules 14. While a relay having two reed switch capsules is shown for the purposes of illustration, it will be understood that the present invention contemplates both single and multiple reed switch capsule embodiments as well. The bobbin 10 is also provided with the integrally formed circumferential flanges 16 and 18 to retain control coils 20, 22, and 24 and the integrally formed base portions 26 and 28. An integrally formed circumferential spacer 30 for positioning the control coils 20, 22, and 24 is also provided. The terminals 32 and 34 extend respectively through the first base portion 26 and the second base portion 28. The leads 40 and 42 of the reed capsules extend to the terminals 32 and 34 and are connected thereto. In the illustrative embodiment, the leads are welded to the terminals, however, other methods of connection, e.g., soldering, are possible. The terminals 32 and 34 provide both mechanical support for the reed capsules 14 and electrical contact thereto. The additional terminals 44, 46, 48 extending below the first and second base portions 26 and 28 are provided for terminating the leads from the control coils as will be hereinafter described. The terminal 50 extending below the spacer 30 is used as a common tie point for other leads from the control coils as will also be hereinafter described.

Figure 2:
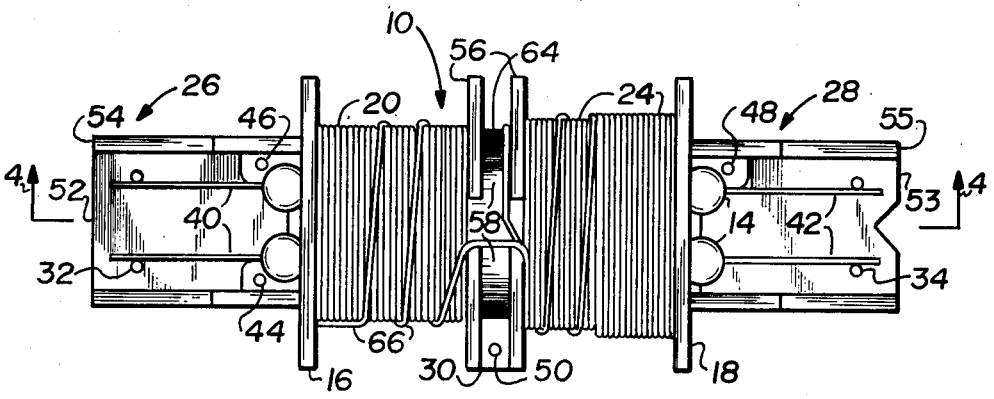
FIG. 2 is a top elevation view of the apparatus of FIG. 1.
Figure 3:
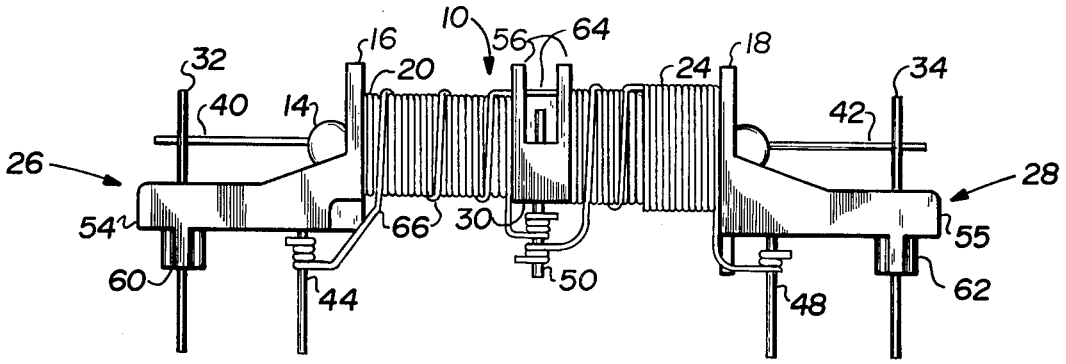
FIG. 3 is a side elevation view of the apparatus of FIG. 1.

FIG. 2 which is a top elevation view of the relay of FIG. 1, and FIG. 3 which is a side elevation view of the relay of FIG. 1 more clearly illustrate the preferred configurations of the first and second base portions 26 and 28 and the circumferential spacer 30. The base portions 26 and 28 extend outwardly from the corresponding circumferential flanges 16 and 18. Each base portion 26 and 28 includes a substantially horizontal portion 52 and a pair of longitudinal flanges 54 that provide mechanical strength to the base portion. As can be clearly seen in FIG. 2, the circumferential spacer 30 includes a pair of circumferential flanges 56. The circumferential flanges 56 each have a channel 58 along the longitudinal axis of the bobbin to permit the passage of a wire therethrough. The flanges 56 are also positioned so as to form a circumferential channel 64 about the surface of the bobbin 10 to permit the passing of a wire therethrough. As can be seen most clearly in FIG. 3, the common terminal 50 is supported by the circumferential spacer 30.

In the embodiment of FIG. 1 the first and second base portions are provided with a total of seven terminals. As can be seen more clearly in the bottom elevation of FIG. 5, the first base portion 26 includes four terminals and the second base portion 28 includes three terminals. The terminals 32 on the base portion 26 and the terminals 34 on the base portion 28 extend vertically upwards and have the leads 40 and 42 respectively connected thereto. The terminals 32 and 34 thereby provide mechanical support for the reed switches 14 and electrical connection thereto. The terminals 32 and 36 also extend vertically downward from the respective base portions to facilitate termination on a printed wiring card. The terminals 44, 46 and 48 extend vertically downwards from the base portions for ease of wire termination from the coils 20, 22 and 24 and to also facilitate termination on a printed wiring card. It should be noted that the common terminal 50 is not intended for termination to the wiring card. The integrally formed spacer 60 and 62, shown most clearly in FIG. 3 and FIG. 4, extend downward from the base portions 26 and 28, respectively and serve to raise the relay above the surface of a printed wiring card to prevent damage to the wire terminations to the terminals 44, 46 and 48.

This bobbin and terminal arrangement is particularly well adapted to conventional coil winding techniques. Prior to insertion of the reed switch capsules 14 into the bobbin 10, the coil wire (typically 34 gauge insulated solid wire) is attached to the terminal 48, the operate coil 22 is then wound in what is assumed to be a clockwise direction for purposes of illustration. The wire is then routed through the circumferential channel 64 and then attached to the common terminal 50. The wire is then wound in a clockwise direction to form the common coil 20 and is terminated on the terminal 46. The wire is then terminated on the terminal 44 forming a strap between terminals 44 and 46. The wire is returned by two clockwise spirals 66 to the channel 58. The release coil is then wound counterclockwise in two layers and the wire is terminated on the common terminal 50. The strap between the terminals 44 and 46 is then removed. In this fashion the coils 20, 22 and 24 are easily wound from a single length of wire. The terminations on the terminals 44, 46, 48 and 50 are then soldered.

After the coils are wound, the reed switch capsules 14 are inserted in the bobbin 10. The reed capsule leads 40 and 42 are then connected to the terminals 32 and 34, respectively, by soldering or welding.

Figure 4:
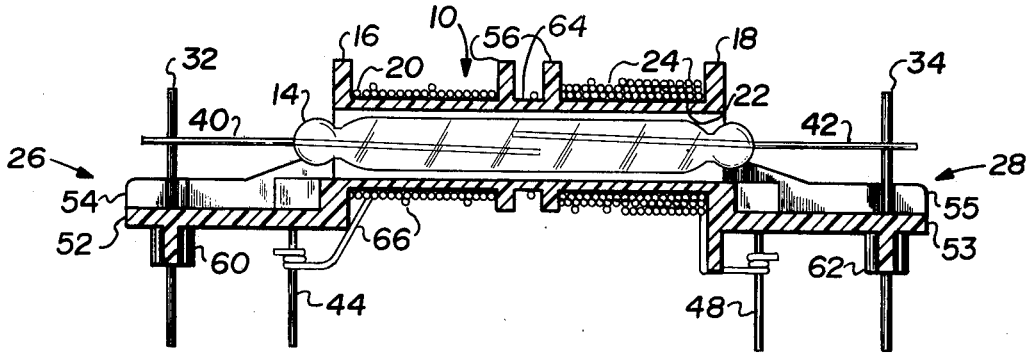
FIG. 4 is a vertical cross-section view taken along section line 4 of FIG. 2.
Figure 5:
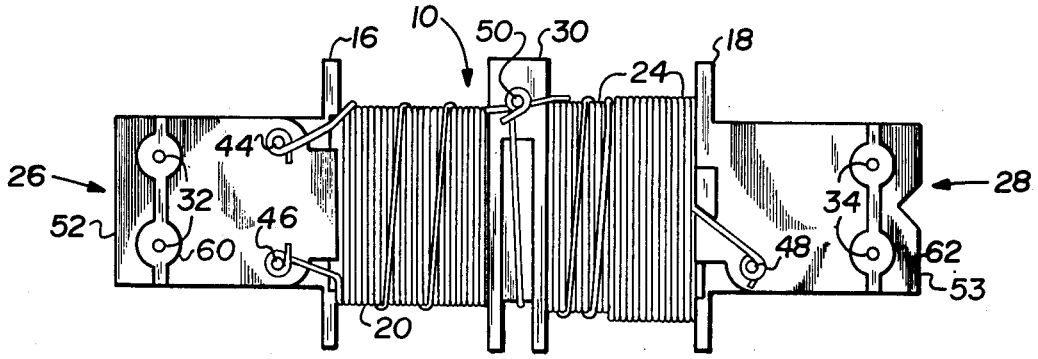
FIG. 5 is a bottom elevation view of the apparatus of FIG. 1.

FIG. 4 is a vertical cross section view along section line 4 of FIG. 1, illustrating the manner in which one of the reed capsules 14 is supported within the bobbin 10 by the terminals 32 and 34. As can also be seen in FIG. 4, the reed capsule is positioned so that overlapping portions of the reeds 64, 66 are at the substantial midpoint of the bobbin 10. The circumferential spacer 30 is also located at the substantial midpoint of the bobbin so that the common coil 20 is positioned about one of the reeds 68 and the operate and release coils 22, 24 are positioned about the other reed 70.

It should be noted that although a three coil arrangement has been described, it will be understood that the present invention contemplates arrangements having more or fewer coils. Since other changes in the above described construction will occur to those skilled in the art without departure from the spirit and scope of the invention, it is intended that all matter set forth in the above description or shown in the appended drawings shall be interpreted as illustrative and not in any limiting sense.

What is claimed is:

1. A reed relay comprising:

an insulative bobbin having a longitudinal channel therein, a first circumferential flange formed at a first end of the bobbin, a second circumferential flange formed at a second end of the bobbin, a first base portion formed at the first circumferential flange, a second base portion formed at the second circumferential flange, and a circumferential spacer formed at the substantial midpoint of the bobbin, the circumferential spacer and the first circumferential flange serving to define a first coil receiving bobbin portion and the circumferential spacer and the second circumferential flange serving to define a second coil receiving bobbin portion;

a first electrically conductive terminal disposed through the first base portion and extending from a first end at the top of the first base portion and from a second end at the bottom of the base portion;

a second electrically conductive terminal disposed through the second base portion and extending from a first end at the top of the second base portion and extending from a second end at the bottom of the second base portion;

an encapsulated reed switch disposed in the longitudinal channel having a first electrical lead connected to the first end of the first electrically conductive terminal and a second electrical lead connected to the first end of the second electrically conductive terminal;

a plurality of coils wound about the bobbin including at least a first coil disposed about the first coil receiving bobbin portion; and means for connecting the coils.

2. A reed relay according to claim 2 wherein said means for connecting the coils includes a first plurality of terminals disposed through the first base portion and extending downward therefrom; and at least one third terminal disposed through the second base portion and extending downward therefrom.

3. A reed relay according to claim 2 wherein the circumferential spacer includes a third and a fourth circumferential flange forming a circumferential channel.

4. A reed relay according to claim 3 wherein the third and fourth circumferential flanges each include a channel along the longitudinal axis of the bobbin.

5. A reed relay according to claim 3 wherein the means for connecting the coils includes a fifth terminal disposed through a portion of the spacer and extending downward therefrom.

6. A reed relay comprising:

an insulative bobbin formed of a thermoplastic material having a longitudinal channel therein and including a first circumferential flange formed at a first end of the bobbin, a second circumferential flange formed at a second end of the bobbin, a first base portion formed at the first circumferential flange, a second base portion formed at the second circumferential flange, and a circumferential spacer formed at the substantial midpoint of the bobbin;

an encapsulated reed switch disposed in the longitudinal channel having a first electrical lead extending over the first base portion and a second electrical lead extending over the second base portion;

a first plurality of terminals disposed through the first base portion, each extending from one end at the bottom of the first base portion, and at least one of the first plurality of terminals extending from its other end at the top of the first base portion and connected to the first electrical lead;

a second plurality of terminals disposed through the second base portion, each extending from one end at the bottom of the second base portion, and at least one of the second plurality of terminals extending from its other end at the top of the second base portion and connected to the second electrical lead;

a plurality of control windings disposed about the bobbin, said control windings being connected to selected ones of the first and second plurality of terminals, and said plurality of control windings including a first winding disposed between the first circumferential flange and the circumferential spacer, and second and third windings disposed between the second circumferential flange and the circumferential spacer.

7. A reed relay according to claim 6 wherein the circumferential spacer includes a terminal for connecting the first, second and third windings.

8. A reed relay according to claim 7 wherein the circumferential spacer includes a third and a fourth circumferential flange disposed so that a circumferential channel is formed at the substantial midpoint of the bobbin.

9. A reed relay according to claim 8 wherein the third and fourth circumferential flanges each have a channel disposed along the longitudinal axis of the bobbin.

* * * * *